US005799808A

United States Patent [19]

Oh

[11] Patent Number: 5,799,808

[45] Date of Patent: Sep. 1, 1998

[54] NURSING BOTTLE

[76] Inventor: Kisuk Oh, 138-400-507 Changmi Apartments, 23-dong, Shinchon-dong, Songpa-gu, Seoul, Rep. of Korea

[21] Appl. No.: 815,615

[22] Filed: Mar. 12, 1997

[51] Int. Cl.[6] ..... A61J 9/00; A61J 9/04

[52] U.S. Cl. ..... 215/11.1; 215/11.5

[58] Field of Search ..... 215/11.1, 11.4, 215/11.5, 11.6; 222/389, 390

[56] References Cited

U.S. PATENT DOCUMENTS

| | | | |
|---|---|---|---|
| 1,938,052 | 12/1933 | Speir | 215/11.5 |
| 2,043,186 | 6/1936 | O'Dette | 215/11.5 |
| 2,469,489 | 5/1949 | Allen et al. | 215/11.1 |
| 2,493,380 | 1/1950 | Bailey | 215/11.5 |
| 3,076,574 | 2/1963 | Woodbury, Jr. | 215/11.1 |
| 3,093,256 | 6/1963 | Woodbury, Jr. | 215/11.1 |
| 3,162,318 | 12/1964 | Woodbury | 215/11 |
| 3,184,120 | 5/1965 | Undi | 222/209 |
| 3,243,069 | 3/1966 | Duerme | 215/11 |
| 3,735,888 | 5/1973 | Jacko | 215/11.5 |
| 4,010,861 | 3/1977 | Welten | 215/11.5 |
| 4,339,046 | 7/1982 | Coen | 215/11.5 |
| 5,078,287 | 1/1992 | Holmes, III | 215/11.6 X |

FOREIGN PATENT DOCUMENTS

| | | | |
|---|---|---|---|
| 167427 | 1/1951 | Austria | 215/11.5 |
| 9460 | 4/1980 | European Pat. Off. | 215/11.1 |
| 439585 | 12/1967 | Switzerland . | |
| 2278061 | 11/1994 | United Kingdom | 215/11.5 |

*Primary Examiner*—Sue A. Weaver

*Attorney, Agent, or Firm*—Townsend and Townsend and Crew LLP

[57] ABSTRACT

A formula bottle, which comprises a support that is installed to allow for rising and falling along the inner wall of the container to support the formula contained therein up to the position of the nipple and a bottom cap that has a breathing hole that facilitates the free rising and falling of the aforementioned support, is distinguished by the forming of the aforementioned container side wall in a rippled shape; the forming of the upper portion of the aforementioned support manufactured with the same material as the aforementioned container in a shape the conforms with the upper portion of the aforementioned container; the forming of the adhesive member set in a fixed position on the aforementioned support so that it maintains a state of close contact with the aforementioned side wall by manufacturing it in a set shape of synthetic rubber material; the forming of a wall in the bottom portion of the aforementioned container to make possible the removal and insertion of the aforementioned support; and the forming of a breathing hole through the screw pitch space through screwing together with the bottom cap.

The result is that the nipple of the formula bottle is always kept filled with formula, the infant is enabled to ingest formula regardless of the angle of nursing or the position of the nipple, and aesthetic expression is possible by the use of a variety of colors.

5 Claims, 3 Drawing Sheets

NURSING BOTTLE

BACKGROUND OF THE INVENTION

The present invention relates generally to a nursing bottle. More specifically, the invention is a nursing bottle that, when filled with formula, allows for the feeding of formula to infants regardless of the angle of nursing or the position of the nipple during nursing.

In general, nursing bottles in use today for feeding infants consist of a container designed to hold dissolved powdered formula at a set degree, and a cap that affixes to the top of the container that is equipped with a nipple.

Additionally, nursing bottles are designed with multiple perforated holes toward the upper portion of the nipple so as to allow the infant to be fed the formula contained in the container through the force of sucking when the nipple is placed to the lips.

These containers are manufactured with a thin, transparent plastic material so that the amount of formula remaining in the nursing bottle may be confirmed. This transparent material is also useful for confirming whether the infant is properly ingesting the formula.

A set amount of formula contained within the nursing bottle that is formed as described above flows to a certain position within the lower portion through downward gravity so that if the nipple portion faces upward, the infant begins to ingest air only.

As a result, the infant must be laid down and maintained in a position to allow the formula to be ingested, and the nipple must be positioned lower so that nursing may take place.

However, if the infant nurses the formula in the state described above in which the infant is laid down, there is a danger that formula entering the infant's mouth may enter the bronchial tube, and there is also the problem that if the formula bottle is either placed horizontally or if the nipple portion is positioned upward, then the infant will either ingest both formula and air together or only air.

Accordingly, a nursing bottle that could be used to feed an infant formula without regard for the angle of bottle or the position of the nipple was seen as necessary. In order to meet this necessity, a nursing bottle that separates formula and the air within the bottle so that formula is always filling the nipple section was introduced in Japan's Utility Model Information Institute Number 47-5186.

As introduced in Japan's Utility Model Information Institute Number 47-5186, a support of a specified thickness capable of sliding along the formula bottle wall by surface contact was installed. A bottom cap equipped with a breathing hole was designed to be screwed in to the bottom of the container, while a nipple perforated to a fixed size was to be installed at the top of the nursing bottle. Through this design, by making it so that the aforementioned support would rise along with the formula through the constant sucking of the infant, air would not be able to enter the bottle via the nipple. One could expect the result that formula would always fill the nipple area.

However, the nursing bottle was manufactured with a clear plastic material formed thinly. As such, the sides would expand to a certain extent because of the temperature of the formula contained therein. When the bottle was subject to this or other external pressure, the shape of the bottle would be transformed. As a result, a gap would be formed between the aforementioned side wall and the support base gap that maintained surface contact with that wall. Formula seeped out through that space and leaked outward through the aforementioned breathing hole in the bottom cap, causing the outside to be messy.

Also, with the aforementioned support coming into surface contact with the side wall, when the infant ceased feeding, it was easy for the support to become slippery through the downward load of the formula. There were problems caused as the support became slippery in this manner: either the formula would leak out through the nipple, or air would come in through the nipple, leading to the infant sucking in and ingesting only air when feeding was resumed.

Another problem was that, with the shape of the aforementioned support being flat, it could not rise to the upper portion of the formula bottle where the diameter narrows, meaning that the infant could not ingest all of the formula contained in the container.

This inventor thus came to contrive the device described herein that seeks to solve the existing problem areas described above.

The goal of the present invention is to provide a nursing bottle that prevents the entry of air inside the device through the nipple, prevents the leakage of formula, allows the infant to be fed without regard for the angle of nursing or the position of the nipple, and allows the infant to ingest the entire amount of the formula contained therein.

SUMMARY OF THE INVENTION

According to the present invention, seeking to arrive at the aforementioned goal, a formula bottle comprising a support that is installed to allow for rising and falling along the inner wall of the container to support the formula contained therein up to the position of the nipple, and a bottom cap that has a breathing hole that facilitates the free rising and falling of the aforementioned support. This bottle is distinguished by the forming of the aforementioned container side wall in a rippled shape; the forming of the upper portion of the aforementioned support manufactured with the same material as the aforementioned container in a shape the conforms with the upper portion of the aforementioned container; the forming of an adhesive member set in a fixed position on the aforementioned support so that it maintains a state of close contact with the aforementioned side wall by manufacturing it in a set shape of synthetic rubber material; the forming of a groove at the bottom of the container to make possible the removal and insertion of the aforementioned support; and the forming of a breathing hole through the screw pitch distance caused by the screwing in with the bottom cap.

Additionally, the aforementioned adhesive member is either manufactured in a tube shape with air injected inside that allows it to change shape flexibly along the aforementioned rippled side wall and maintain its close contact, or it is produced in a ring shape that consists of at least one or more ring protrusions designed to maintain close contact through elasticity with the aforementioned rippled wall.

An alternate embodiment of the invention is designed to attain the aforementioned goal is a formula bottle consisting of the support that is installed so as to allow rising and falling along the inner wall of the container and thus support the formula contained therein to the position of the nipple, and a bottom cap that has a breathing hole to allow the aforementioned support to rise and fall freely. In regards to this bottle, it is distinguished by the forming of the side wall of the aforementioned container in a rippled shape; the forming of the upper portion of the aforementioned support, produced with a material similar to that of the aforementioned container, so that it conforms with the upper portion of the aforementioned container; the forming of the adhesive member set in a fixed position on the aforementioned support so that it maintains a state of close contact with the aforementioned side wall by manufacturing it in a set shape of synthetic rubber material; the forming of the upper portion of the aforementioned container large enough so that removal and insertion of the aforementioned support is possible; the forming so that the shape of the cap that screws in to the top portion of the aforementioned container conforms with the upper portion of the aforementioned container; and the screwing in of a bolt with a breathing hole in a fixed position on the bottom of the aforementioned container.

DESCRIPTION OF THE PREFERRED EMBODIMENT

Below a detailed description of concrete embodiments of this device is given, referring to the attached drawings.

Figure 1:
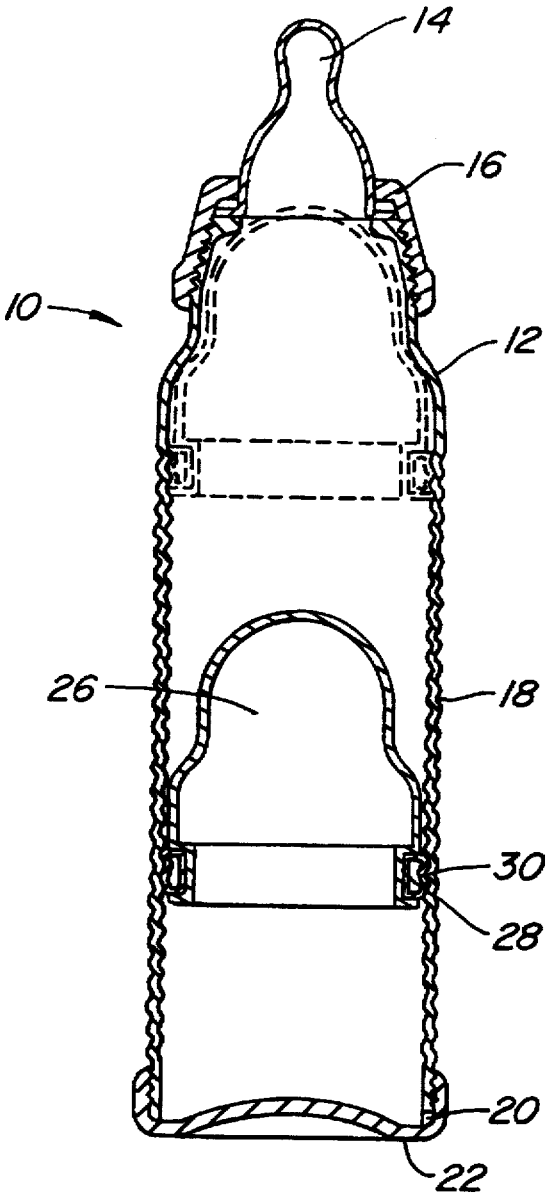
FIG. 1 is a vertical profile drawing, depicting the nursing bottle according to a first embodiment of the invention.

Describing the first embodiment of this device by referring to FIGS. 1–5, there is illustrated a formula bottle 10, comprising a cylindrical container (12) that is produced with a transparent plastic with a fixed degree of elasticity and strength. The upper portion of the container is structured (e.g., threaded, as FIG. 1 illustrates) to receive a cap (16) that is affixed with a nipple (14) with one or more perforated holes that allow the infant to easily ingest the formula.

Figure 6:
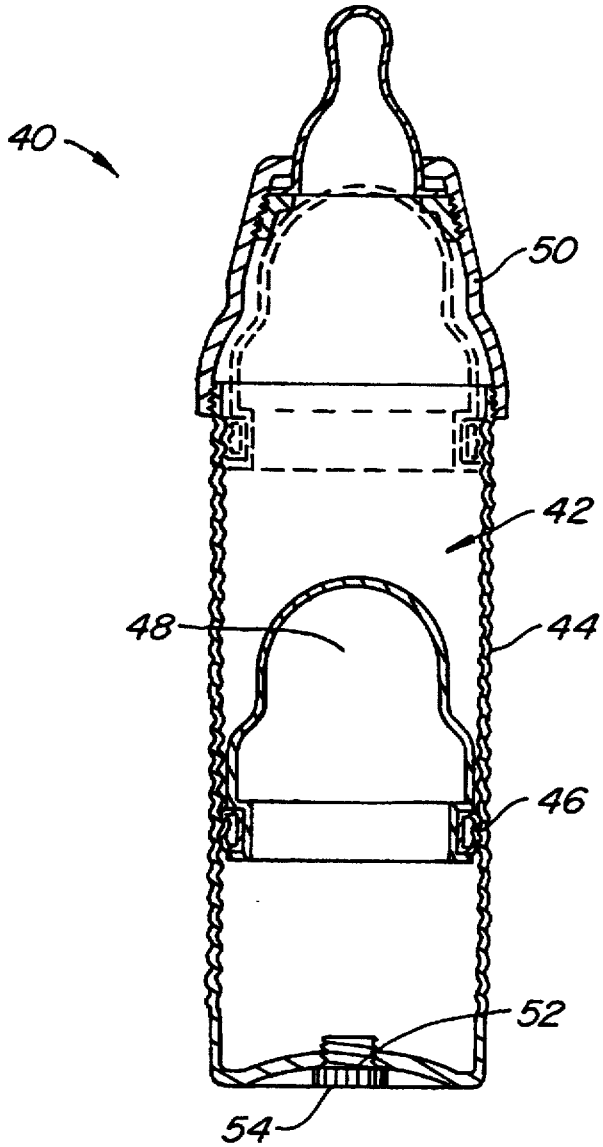
FIG. 6 is a vertical profile depicting the nursing bottle according to a second embodiment of the invention.

The side wall (18) of the container (12), as can be seen in FIGS. 1 and 6, has an undulating or rippled shape that adds structural integrity to the container (12), preventing changes in shape caused by external shock or a certain amount of pressure. At the bottom portion of the container (12) is a groove (20) (best seen in FIG. 4) of a fixed size, while the outer wall of the base of the container (12) is formed with threads (21) so that a bottom cap (22) with a female screw (23) and formed to cover the base of the container (12) may be installed on the bottom portion of the container (12).

Figure 4:
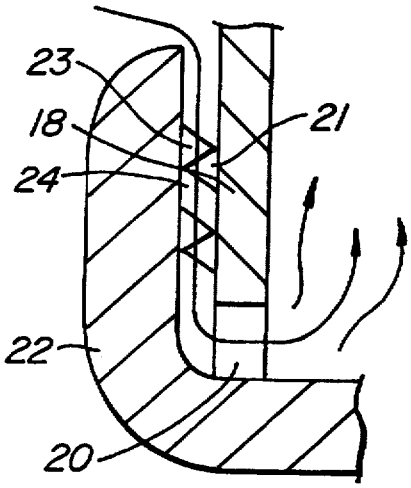
FIG. 4 is an expanded cross-sectional drawing; depicting an embodiment of the screwing in of the bottom cap of FIG. 1.

The screw pitch that forms the aforementioned male threads (21) and female screw (23), forms a shape in which a portion is cut off in the shape of the circumference of the container (12) and the bottom cap's (22) side wall (18). When the aforementioned container (12) and bottom cap (22) are screwed together, the aforementioned cut-off portion forms, as FIG. 4 shows, into a single passage (24).

As for the groove (20) formed at the lower portion of the aforementioned passage (24) and container (12), if aligned straight, the aforementioned passage (24) and groove (20) act as a breathing hole that makes possible the inflow of a set amount of air to the inside of the base of the container (12). If a gasket (not depicted) of a certain shape is placed in between the lower end of the aforementioned container (12) and the bottom cap (22), the inside of the container (12) is kept airtight.

At the same time, within the container (12) a support (26) of a certain shape manufactured with the same material as the container (12) is inserted when the aforementioned bottom cap (22) is open. A more detailed description of the shape of such a support (26) will be provided, referring to the drawings.

The upper portion of the aforementioned support (26), as depicted in FIG. 1, is shaped so that it conforms generally to the interior shape of the upper portion of the container (12), while the lower portion of the support (26) is shaped to a certain height and thickness so as to maintain a balance with the side wall (18) through a shape that remains close to the side wall (18) of the container (12).

A circumferential groove (28) of a set size is formed on the outer side of the base of the support (26). This place groove (28) is configured to receive an adhesive member (30), which is formed to maintain a state of close contact with the rippled side wall (18) yet be able to effectively seal a formula held in the space of the container between the support (26) and the nipple (14) so that it may rise and fall within the container.

Figure 2:
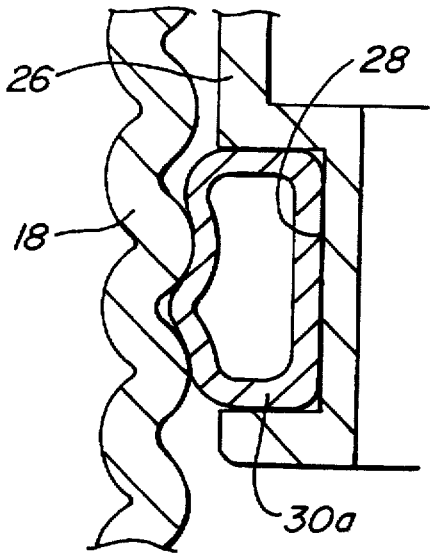
FIG. 2 is an expanded, cross-sectional drawing, depicting the first embodiment of the adhesive member of FIG. 1.
Figure 3:
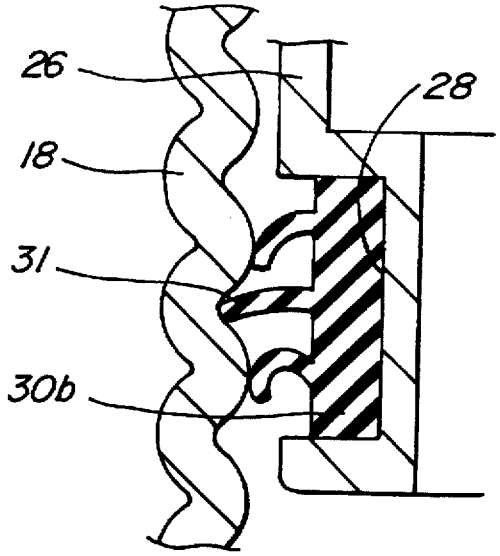
FIG. 3 is an expanded cross-sectional drawing depicting a second embodiment of the adhesive member FIG. 1.

The material used for the adhesive member (30) is preferably a pliable synthetic rubber, such as either a silicone resin or urethane resin, and its shape can either be that of a circumferential, hermetically sealed tube (**30*a*) with for example air inserted inside, as depicted in FIG. 2, or, as depicted in FIG. 3, it can be in the shape of a ring (30*b*) that has at least one circumferential ring protrusion or flange (31) facing outward (toward the container's interior surface). The flange (31) is designed to keep close contact with the aforementioned side wall (18**) through elasticity.

The operating relationships of this device through the aforementioned adhesive member (30) will now be described. A set amount of formula is placed in the nursing bottle (10) that has been made in the manner described above. In this state, the infant begins to ingest the formula by sucking through the nipple. As this happens, the aforementioned support (26) gradually rises as it is forced to move upward to the degree of reduction in the amount of formula contained in the container (12).

At this time, the adhesive member (30) affixed to the support (26), as depicted in FIG. 2 becomes flexible through the air inside the adhesive member (**30*a*) that has the shape of the air-inflated ring-like tube or bladder that maintains a state of close contact with the rippled side wall (18**) and rising to the point of the dotted line as depicted in FIG. 1.

As the adhesive member (**30*a*) maintains its close contact with the rippled side wall (18) and rises as described above, not only does it receive support from the side wall (18), but it also prevents the leakage of formula through any space between the side wall (18) and the support (26). Also, through the rising motion of the support (26) that is shaped to conform with the upper portion of the container (12), the formula, supported by the support (26), is pushed up to the nipple (14) at the top of the container (12**).

Additionally, if a ring-shaped adhesive member (**30*b*) that has numerous ring protrusions (31) as depicted in drawing 3 is used for the aforementioned adhesive member (30), the ring protrusion (31) of the adhesive member (30*b***) that protrudes outward will elastically change shape, rising while maintaining close contact with the jagged portion of the rippled side wall (18). In doing so, it acts in a manner similar to the aforementioned tube-shaped (30*a*) adhesive member (30).

Figure 5:
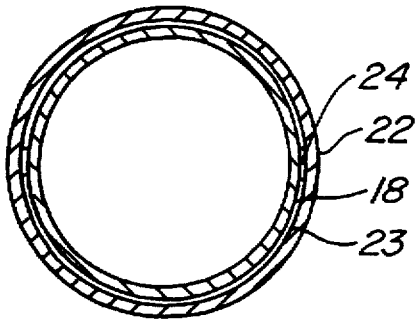
FIG. 5 is a planar cross-sectional drawing depicting the embodiment of the screwing in of the bottom cap of FIG. 4.

The breathing hole designed to effectively inject air to the inside of the container—since air must flow into the lower portion of the container (12) during into the rising action of the aforementioned support (26)—will be explained while referring to FIGS. 4 and 5.

As described above, with the screwing in of the bottom cap (22) to the bottom portion of the container (12), the cut-out portion of a set size of the screw pitch will form a passage (24). Air necessary for the rising of the support (26) flows in as depicted by the arrows through the passage (24) and the groove (20) formed at the lower end of the aforementioned container (12).

Moreover, if a gasket (not depicted) of a set shape is inserted and used between the aforementioned container (12) and the bottom cap (22), then leakage of formula contained in the container (12) can be prevented, and it may be used in a manner similar to conventional formula bottles (not depicted) in which the aforementioned support (26) is not installed.

Describing the second embodiment of this device by referring to FIG. 6, the formula bottle (40) according to the second embodiment consists of, as in embodiment one, a container (42) with a ripple-shaped side wall (44) and a support (48) onto which is fixed an adhesive member (46) that maintains close contact with the side wall (44) on the inside of the container (42) and allows for the rising and falling of the support.

The shape of the cap (50) that connects to the top of the container (42) is made in a form of set size that allows the aforementioned support (48) to be inserted through the top of the container (42).

Moreover, so that there is free upward and downward movement of the support (48) that is inserted as described above, the bottle is produced with a structure in which a bolt (54) that has a set shape and that contains a breathing hole (52) is connected to the base of the container (42).

This device as formed through the embodiments described above has a structural strength against external shock or a fixed degree of pressure because the side walls are formed in a rippled shape. This also has the effect of preventing any leakage of formula contained therein by maintaining a state of close contact even when subject to external shock or pressure, since the support retains its position through the adhesive member that maintains close contact with the wall, and at the same time it is made of a material similar to that of the container itself.

Moreover, formula is pushed upward to the nipple at the top through the shape of the adhesive member and the support so that the nipple is always being filled with formula. As a result, the infant may ingest the formula regardless of the position of the nipple or the angle of nursing bottle. One effect of the nipple always being filled with the formula contained in the bottle is that aesthetic expression is possible through the use of non-transparent plastic materials and a variety of colors for the container.

In summary, there has been disclosed a formula bottle which comprises a container, a support that is installed in the container to rise and fall along the inner wall of the container to support a formula contained by the container up to the position of the nipple, and a bottom cap that has a breathing hole that facilitates the free rising and falling of the aforementioned support. The formula bottle a container side wall in a rippled shape. The upper portion of the support is manufactured from the same material as the container, and is shaped and configured to conform with the upper portion of the container. An adhesive member is set in a fixed position on the support so that it maintains a state of close contact with the aforementioned side wall by, for example, manufacturing it in a set shape of synthetic rubber material. The upper portion of the container is formed large enough to make possible the removal and insertion of the support, and a cap screws onto the upper portion of the container so that it conforms to the upper portion of the container. Finally, the lower portion of the container is provided a breathing hole.

Although only concrete embodiments of this device are described in detail above, the possibilities for varied changes and modifications within the technical concepts of this invention are clear to this party, and it is a matter of course that such changes and modifications fall under the scope of the attached utility model application.

I claim:

1. A formula bottle, comprising:

a container for containing a formula, having circumferential undulations to form an undulating inner side wall;

a nipple attached to the container;

a support installed in the container and moveable along the undulating inner side wall to support a formula within the container up to the nipple, the support including means for engaging the undulating inner side wall to seal the formula in the container and permit movement of the support along the undulating inner side wall;

a bottom cap coupled to the container and having a breathing hole that facilitates the free rising and falling of the support.

2. The formula bottle of claim 1, wherein the means for engaging is a member positioned between the support and the undulating inner side wall and circumferentially surrounding the support, the member being formed and configured to flexibly change shape.

3. The formula bottle of claim 1, wherein the means for engaging is a member circumferentially surrounding the container and having a ring protrusion that allows for close contact through elasticity with the undulating inner side wall.

4. The formula bottle of claim 1, wherein the means for engaging is a member circumferentially surrounding the container and having a plurality of ring protrusions that establish sealing contact, through elasticity, with the undulating inner side wall.

5. A formula bottle, comprising:

a container having an undulating inner side wall formed from a plurality of circumferential, alternating concave and convex regions;

a nipple attached to the container;

a support installed in the container and moveable along the undulating inner side wall to support a formula within the container up to the nipple, the support including seal means to engage the undulating inner side wall to seal the formula in the container and permit movement of the support along the undulating inner side wall;

a removable bottom cap connected to the container to enclose the support, the bottom cap having a breathing hole that facilitates the free rising and falling of the support.

* * * * *